US005985453A

United States Patent [19]

Moriya et al.

[11] Patent Number: 5,985,453

[45] Date of Patent: Nov. 16, 1999

[54] RECORDING MEDIUM, AND INK-JET PRINTING PROCESS AND IMAGE FORMING PROCESS USING THE SAME

[75] Inventors: Kenichi Moriya, Urayasu; Masahiko Higuma, Togane; Yuko Sato, Kawasaki, all of Japan

[73] Assignee: Canon Kabushiki Kaisha, Tokyo, Japan

[21] Appl. No.: 08/888,315

[22] Filed: Jul. 3, 1997

[30] Foreign Application Priority Data

Jul. 18, 1996 [JP] Japan ..... 8-189324
Apr. 18, 1997 [JP] Japan ..... 9-101758

[51] Int. Cl.[6] ..... B41M 5/00

[52] U.S. Cl. ..... 428/411.1; 428/195; 428/423.1; 428/480; 428/500; 428/520; 428/535

[58] Field of Search ..... 428/195, 520, 428/537.5, 423.1, 532, 480, 500, 411.1, 535

[56] References Cited

U.S. PATENT DOCUMENTS

| | | | |
|---|---|---|---|
| 4,371,582 | 2/1983 | Sugiyama et al. | 428/341 |
| 4,830,911 | 5/1989 | Kojima et al. | 428/342 |
| 4,877,680 | 10/1989 | Sakaki et al. | 428/332 |
| 5,101,218 | 3/1992 | Sakaki et al. | 346/1.1 |

FOREIGN PATENT DOCUMENTS

| | | |
|---|---|---|
| 365307A2 | 4/1990 | European Pat. Off. . |
| 545470A1 | 6/1993 | European Pat. Off. . |
| 627324A1 | 12/1994 | European Pat. Off. . |
| 678397A1 | 10/1995 | European Pat. Off. . |
| 54-59936 | 5/1979 | Japan . |
| 57-36692 | 2/1982 | Japan . |
| 58-177390 | 10/1983 | Japan . |
| 59-20696 | 2/1984 | Japan . |
| 59-146889 | 8/1984 | Japan . |
| 59-198186 | 11/1984 | Japan . |
| 59-198188 | 11/1984 | Japan . |
| 61-277484 | 12/1986 | Japan . |
| 62-174184 | 7/1987 | Japan . |
| 63-115780 | 5/1988 | Japan . |
| 63-280681 | 11/1988 | Japan . |
| 7-61113 | 3/1995 | Japan . |
| 8-108618 | 4/1996 | Japan . |

*Primary Examiner*—Pamela R. Schwartz
*Attorney, Agent, or Firm*—Fitzpatrick, Cella, Harper & Scinto

[57] ABSTRACT

Disclosed herein is a printing medium, comprising a base material and an ink-receiving layer provided on at least one side of the base material, wherein the ink-receiving layer comprises, in combination as essential components, a hydrophilic resin and a cationic compound comprising both structural units of the formulae (I) and (II)

(I)

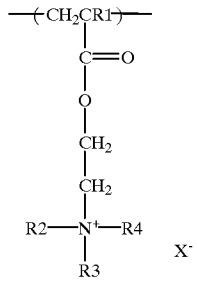

and (II)

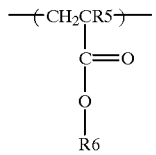

wherein R1, R2, R4 and R5 are independently hydrogen or an alkyl group having 1 to 3 carbon atoms, R3 is a phenyl, naphthyl, benzyl or phenethyl group, R6 is an alkyl group the main chain of which has 10 to 30 carbon atoms, and $X^-$ is a halide ion selected from the group consisting of chloride, bromide and iodide ions, a sulfate ion, an alkylsulfate ion selected from the group consisting of methylsulfate and ethylsulfate ions, an alkyl- or arylsulfonate ion, or an acetate ion, and the cationic compound is used in combination in a proportion of 1 to 40 parts by weight per 100 parts by weight of the hydrophilic resin.

21 Claims, No Drawings

RECORDING MEDIUM, AND INK-JET PRINTING PROCESS AND IMAGE FORMING PROCESS USING THE SAME

BACKGROUND OF THE INVENTION

1. Field of the Invention

The present invention relates to a printing medium suitable for use in ink-jet printing, and an ink-jet printing process and an image forming process using such a printing medium.

2. Related Background Art

An ink-jet printing method is a recording method in which recording is conducted by generating and ejecting droplets of an ink by one of various ink ejection systems, for example, an electrostatic attraction system, a system using a piezoelectric element to give an ink mechanical vibration or displacement, or a system in which an ink is heated to form bubbles in the ink, thereby using the pressure thus produced, and applying the droplets in whole or in part to a printing medium such as paper or a plastic film coated with an ink-receiving layer. The ink-jet printing method attracts attention as a printing method which produces minimal noise and can conduct high-speed printing and multi-color printing.

As inks for ink-jet printing, inks comprising water as a principal component are mainly used due to issues of safety, printability, etc. Water-soluble organic solvents such as polyhydric alcohols are often added to such inks with a view toward preventing clogging of orifices and improving ejection stability.

As printing media heretofore used in ink-jet printing, there are described, for example, a printing sheet comprising a water-insoluble polymer latex composed of a copolymer with a monomer having a tertiary amino group or quaternary ammonium group in Japanese Patent Application Laid-Open No. 57-36692, a printing sheet comprising an electric-conductive agent of the quaternary ammonium salt type in Japanese Patent Application Laid-Open No. 58-177390, a printing sheet comprising a diallyldialkylammonium halide in Japanese Patent Application Laid-Open No. 59-20696, and a printing sheet comprising a dicyandiamide-formalin condensate in Japanese Patent Application Laid-Open No. 59-146889.

Besides, there are described a printing sheet comprising a quaternary cationic or amine compound in Japanese Patent Application Laid-Open No. 61-277484, a printing sheet comprising polyallylamine hydrochloride in Japanese Patent Application Laid-Open No. 62-174184, a printing sheet comprising an organic acid salt of polyethyleneimine in Japanese Patent Application Laid-Open No. 59-198186, a printing sheet comprising a quaternized product of polyethyleneimine in Japanese Patent Application Laid-Open No. 59-198188, a printing sheet comprising a poly (dialkanolallylamine) derivative in Japanese Patent Application Laid-Open No. 63-280681, a printing sheet comprising a polymer based on a (meth)acrylic acid alkyl quaternary ammonium salt or a polymer based on a (meth) acrylamidoalkyl quaternary ammonium salt in Japanese Patent Application Laid-Open No. 63-115780, and a printing medium comprising a polyvinyl acetal resin and a cationic compound as essential components in Japanese Patent Application Laid-Open No. 7-61113.

Furthermore, there is also proposed an additive for ink-jet printing comprising, as an active ingredient, a polymer based on a (meth)acrylic acid alkyl quaternary ammonium salt having a benzyl group or a polymer based on a (meth) acrylamidoalkyl quaternary ammonium salt having a benzyl group in Japanese Patent Application Laid-Open No. 8-108618.

With the improvement in performance of ink-jet printing apparatus, such as speeding up of printing and multi-coloring of images, in recent years, ink-jet printing media have also been required to have improved properties. Particularly, the printing media are required to have the following five properties:

(1) being able to stably store an image formed thereon for a long period of time without deterioration in a high-temperature and high-humidity environment;

(2) providing a printed image having excellent light fastness;

(3) having high ink absorptivity (absorbing capacity being great, and absorbing time being short);

(4) providing dots high in optical density and clear in periphery; and (5) having an ink-receiving layer excellent in water resistance and providing a printed image excellent in water fastness.

In addition to the above properties, such printing media are required to satisfy the following properties at the same time:

(6) being excellent in adhesion between an ink-receiving layer and a base material;

(7) providing dots having a substantially round shape and a smooth periphery;

(8) undergoing little change in properties even at varied temperatures and humidities and undergoing no curling;

(9) undergoing no blocking; and

(10) being stable without undergoing deterioration even when stored for a long period of time (particularly, in a high-temperature and high-humidity environment).

Besides, printing sheets for OHP, and the like, are further required to have excellent transparency in addition to the above requirements. More specifically, not only a film as a base material but also an ink-receiving layer provided thereon is required to have excellent transparency.

On the other hand, for white base materials such as white films and resin-coated paper, ink-receiving layers provided thereon are also required to have excellent transparency so as not to impair the whiteness and/or the glossy feeling of the base materials themselves. With respect to glossiness in particular, it is a matter of course that the glossiness of an unprinted portion of an opaque printing medium be high, and it is also necessary for a printed portion to have high glossiness.

These properties are often in a relation of trade-off. It has hence been impossible to satisfy them at the same time by the conventionally known techniques.

Especially, as ink-jet techniques become more widespread, opportunities for printing, storing and posting at various places are increasing. Therefore, discoloration or bleeding of printed images becomes a serious problem upon exposure to temperature, humidity or sunlight.

In order to obtain prints comparable to a silver salt photograph by ink-jet printing, there is a demand for development of a printing medium capable of providing an image with brighter colors.

As the exemplified printing media of the prior art, for example, the printing sheets comprising a cationic compound proposed in Japanese Patent Application Laid-Open Nos. 57-36692, 58-177390, 59-20696, 59-146889, 61-277484, 62-174184, 59-198186, 59-198188, 63-280681, 63-115780 and 7-61113 are recognized to provide an image greatly improved in water fastness compared with any printing sheet without an addition of a cationic compound when conducting ink-jet printing. However, the resultant image on each printing sheet undergoes a change in the hue of an ink-jet printed portion though it somewhat varies according to the kinds of dyes used, so that the color of the image becomes greatly different from the hue inherent in the dye, or the image becomes a dull image having poor brightness. The reason for it is considered to be attributable to the fact that the cationic compound is ionically bonded to the dye to form a great polymeric complex, so that the aggregating state of the dye undergoes a change, and the light absorption spectrum inherent in the dye is hence varied. Further, in printing sheets obtained by providing an ink-receiving layer on a support, such as sheets for OHP, images printed thereon bleed when left to stand in a high-temperature and high-humidity environment (for example, 30° C./80% RH) even if such a cationic compound as proposed in the prior art is used.

With the increase of printing density in ink-jet printing methods in recent years, i.e., increase in shot-in ink quantity, the resistance to bleeding of an image when the image is left to stand in a high-temperature and high-humidity environment (for example, 30° C./80% RH) comes to be unsatisfactory under the circumstances though it has heretofore been at an entirely satisfactory level.

Further, the printing sheets proposed in the prior art provide an image markedly poor in light fastness compared with printing sheets containing no cationic compound, and so the necessity of improving the light fastness of the resulting image is pointed out.

When a printing medium for ink-jet is prepared by mixing the additive for ink-jet printing proposed in Japanese Patent Application Laid-Open No. 8-108618 with a hydrophilic resin and applying the mixture to a transparent PET film to form an ink-receiving layer, and ink-jet printing is conducted thereon, an image, which is entirely satisfactory in coloring and light fastness, is provided. However, the ink-jet printed image is not wholly satisfactory as to resistance to bleeding when the image is left to stand in a high-temperature and high-humidity environment (for example, 30° C./80% RH).

SUMMARY OF THE INVENTION

It is accordingly an object of the present invention to provide a printing medium which satisfies the above-described various properties at the same time in a well-balanced relation, and particularly to provide a printing medium which can provide an image undergoing no changes such as bleeding even when it is left to stand for a long period of time under environmental conditions of a high-temperature and a high-humidity after printing and having excellent light fastness compared with any printing medium containing no cationic compound, and an ink-jet printing process and an image forming process using such a printing medium.

The above object can be achieved by the present invention described below.

According to the present invention, there is thus provided a printing medium, comprising a base material and an ink-receiving layer provided on at least one side of the base material, wherein the ink-receiving layer comprises, in combination as essential components, a hydrophilic resin and a cationic compound comprising both structural units of the formulae (I) and (II)

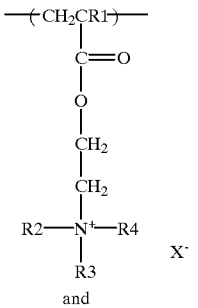

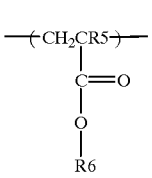

wherein R1, R2, R4 and R5 are independently hydrogen or an alkyl group having 1 to 3 carbon atoms, R3 is a phenyl, naphthyl, benzyl or phenethyl group, R6 is an alkyl group the main chain of which has 10 to 30 carbon atoms, and $X^-$ is a halide ion selected from the group consisting of chloride, bromide and iodide ions, a sulfate ion, an alkylsulfate ion selected from the group consisting of methylsulfate and ethylsulfate ions, an alkyl- or arylsulfonate ion, or an acetate ion, and the cationic compound is used in combination in a proportion of from 1 to 40 parts by weight per 100 parts by weight of the hydrophilic resin.

According to the present invention, there is also provided an ink-jet printing process comprising the steps of providing inks, and ejecting the inks from orifices of a printing head in response to printing signals to apply the inks to the printing medium described above, thereby conducting printing.

According to the present invention, there is further provided an image forming process comprising the steps of providing water-based inks, and applying the water-based inks to the printing medium described above, thereby forming an image.

DESCRIPTION OF THE PREFERRED EMBODIMENTS

In the course of research and development of printing paper suitable for use in ink-jet printing and a glossy, photograph-like printing medium, the present inventors have found that a printing medium coated with the above-described composition is excellent in performance characteristics such as ink absorbing capacity, ink-fixing ability, resistance to blocking, water fastness or water resistance and resistance to leaving fingerprints, and brings about such various effects that it provides images clear and sharp in dots and excellent in image quality, undergoes little change in the performance characteristics even when environmental conditions such as temperatures and humidities vary, permits the formation of images capable of being stably stored for a long period of time, particularly, under environmental conditions of a high temperature and high humidity (having excellent shelf stability of image), is also excellent in transparency and suitability for OHP when using a transparent base material, and does not bring problems of reductions in whiteness and glossiness even when using a white base material such as a white film or resin-coated paper, so that high glossiness can be realized at printed portions, nor further problems of reduction in light fastness and coloring ability though it contains a cationic compound, thus leading to completion of the present invention.

The present invention will hereinafter be described in detail by the preferred embodiments.

The hydrophilic resin as the first compound used in the present invention means a water-soluble resin or a water-dispersible resin capable of receiving the so-called water-based inks and showing solubility in or affinity for the water-based inks. As examples of the water-soluble resins, may be mentioned synthetic resins such as polyvinyl alcohol and modified products thereof such as anionically modified polyvinyl alcohol, cationically modified polyvinyl alcohol and acetal-modified polyvinyl alcohol; polyurethane; polyvinyl pyrrolidone and modified products thereof such as copolymers of polyvinyl pyrrolidone and vinyl acetate, copolymers of vinylpyrrolidone and dimethylaminoethylmethacrylate, copolymers of quaternized vinyl pyrrolidone and dimethylaminoethylmethacrylate and copolymers of vinylpyrrolidone and methacrylamidopropyltrimethyl-ammonium chloride; cellulosics such as carboxymethyl cellulose, hydroxyethyl cellulose and hydroxypropyl cellulose, and modified products thereof such as cationic hydroxyethyl cellulose; polyester, polyacrylic acid (esters), melamine resins and modified products thereof, and copolymers of polyurethane and polyester; and natural resins such as albumin, gelatin, casein, starch, cationic starch, gum arabic and sodium alginate, to which, however, the invention is not limited. Among these water-soluble resins, polyvinyl alcohol, cationically modified polyvinyl alcohol, acetal-modified polyvinyl alcohol, polyurethane, polyester and copolymers of polyurethane and polyester are particularly preferred from the viewpoint of coloring ability and ink absorbency.

As examples of the water-dispersible resin, may be mentioned a great number of resins such as polyvinyl acetate, ethylene-vinyl acetate copolymers, polystyrene, styrene-(meth)acrylate copolymers, (meth)acrylate polymers, vinyl acetate-(meth)acrylic acid (ester) copolymers, poly(meth) acrylamide, (meth)acrylamide copolymers, styrene-isoprene copolymers, styrene-butadiene copolymers, ethylene-propylene copolymers, polyvinyl ether and silicone-acrylic copolymers. However, it goes without saying that the invention is not limited to these resins. Those containing units such as N-methylolacrylamide and having self-crosslinking ability may be used. A plurality of these hydrophilic resins may be used at the same time.

The cationic compound as the second compound used in the present invention is a compound comprising both structural units of the formulae (I) and (II) as essential components. However, such a compound may further contain other structural units so far as it comprises both structural units of the formulae (I) and (II) as essential components.

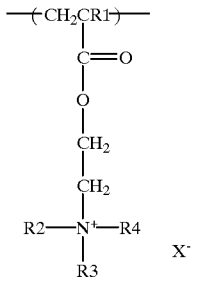

(I)

and

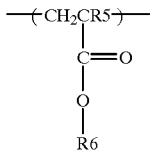

(II)

wherein R1, R2, R4 and R5 are independently hydrogen or an alkyl group having 1 to 3 carbon atoms, R3 is a phenyl, naphthyl, benzyl or phenethyl group, R6 is an alkyl group the main chain of which has 10 to 30 carbon atoms, and $X^-$ is a halide ion selected from the group consisting of chloride, bromide and iodide ions, a sulfate ion, an alkylsulfate ion selected from the group consisting of methylsulfate and ethylsulfate ions, an alkyl- or arylsulfonate ion, or an acetate ion.

Specific preferable examples of this cationic compound are shown in Table 1 below.

TABLE 1

| | R1 | R2 | R3 | R4 | R5 | R6 |
|---|---|---|---|---|---|---|
| Example 1 | H | $CH_3$ | 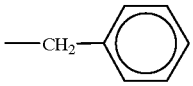 | $CH_3$ | H | $C_{18}H_{37}$ |
| Example 2 | H | $CH_3$ | 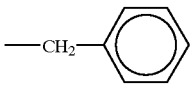 | $CH_3$ | H | $C_{12}H_{25}$ |
| Example 3 | $CH_3$ | $CH_3$ | 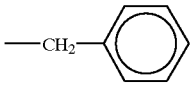 | $CH_3$ | H | $C_{18}H_{37}$ |
| Example 4 | $CH_3$ | $CH_3$ | 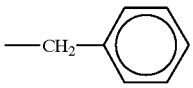 | $CH_3$ | H | $C_{12}H_{25}$ |
| Example 5 | H | $CH_3$ | 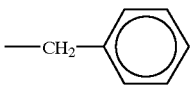 | $CH_3$ | $CH_3$ | $C_{18}H_{37}$ |

TABLE 1-continued

| | R1 | R2 | R3 | R4 | R5 | R6 |
|---|---|---|---|---|---|---|
| Example 6 | H | $CH_3$ | —$CH_2$— | $CH_3$ | $CH_3$ | $C_{12}H_{25}$ |
| Example 7 | $CH_3$ | $CH_3$ | —$CH_2$— | $CH_3$ | $CH_3$ | $C_{18}H_{37}$ |
| Example 8 | $CH_3$ | $CH_3$ | —$CH_2$— | $CH_3$ | $CH_3$ | $C_{12}H_{25}$ |

The cationic compound useful in the practice of the present invention is greatly different from the conventional cationic compounds in the following two points:

1) it has a functional group the quaternized nitrogen atom of which has an aromatic ring, and
2) it has an alkyl group the main chain of which has 10 to 30 carbon atoms.

The reason why the cationic compound used in the present invention can provide a printing medium excellent in all three properties of shelf stability of image, light fastness and coloring ability is not clear. However, the shelf stability of image is considered to be improved by the fact that a dye used in an ink becomes unlikely to be affected by humidity due to existence of hydrophobic moieties such as the aromatic ring and the alkyl group the main chain of which has 10 to 30 carbon atoms around an associated product formed by ionic bonding between the dye and the quaternized cationic moiety, or steric hindrance by the aromatic ring and the alkyl group the main chain of which has 10 to 30 carbon atoms, so that the dye is unlikely to be dissociated. The reason why the coloring ability is not lowered is considered to be attributable to the fact that since the aromatic ring and the alkyl group the main chain of which has 10 to 30 carbon atoms sterically hinder when the dye is ionically bonded to the cationic compound, a great polymeric complex is unlikely to be formed, so that the aggregating state of the dye undergoes no change, and the light absorption spectrum inherent in the dye is hence not varied. Therefore, it is avoidable that the color of the resulting image becomes greatly different from the hue inherent in the dye, or the image becomes a dull image having poor brightness.

It is preferable that the proportions of the structural units of the formulae (I) and (II) in the cationic compound be within ranges of from 60% by weight to 95% by weight and from 5% by weight to 40% by weight, respectively. The proportion of the structural unit of the formula (I) is more preferably within a range of from 70% by weight to 95% by weight, most preferably from 75% by weight to 95% by weight. The proportion of the structural unit of the formula (II) is more preferably within a range of from 5% by weight to 30% by weight, most preferably from 5% by weight to 25% by weight.

The weight average molecular weight of the cationic compound is preferably within a range of from 10,000 to 500,000, more preferably from 10,000 to 200,000, most preferably from 10,000 to 100,000. If the weight average molecular weight is lower than 10,000, the film-forming property of the resulting composition becomes low, so that a film formed may become sticky. If the weight average molecular weight is higher than 500,000 on the other hand, no problem arises regarding the film-forming property of the resulting composition, but the ink absorbency of the composition is deteriorated, which forms the main cause that the ink absorbency of the resulting mixture of such a cationic compound and the hydrophilic resin is deteriorated.

A cationic compound of the formula (I) in which R is benzyl or naphthyl can be used. Among the cationic compounds mentioned above, compounds in which R3 is a benzyl group, and R6 is a long-chain alkyl group the main chain of which has 12 to 18 carbon atoms are particularly preferred.

With respect to the proportions of the hydrophilic resin and the cationic compound used in combination in the present invention, it is preferable to use the cationic compound in a proportion of from 1 to 40 parts by weight, preferably from 5 to 30 parts by weight, more preferably from 5 to 25 parts by weight per 100 parts by weight of the hydrophilic resin.

If the mixing ratio of the hydrophilic resin to the cationic compound is higher than 100/1 when combining them with each other, the effect of the cationic compound added is not brought about correspondingly, so that the effect of improving the shelf stability of image is not satisfactorily brought about. If the mixing ratio of the cationic compound to the hydrophilic resin is higher than 40/100 on the other hand, the effect of improving the light fastness is not satisfactorily brought about. Additionally, the ink absorbency of the resulting ink-receiving layer is deteriorated, and the resulting printing medium provides an image deteriorated in evenness of a solid printed portion and tends to cause bleeding at boundaries between different colors.

In order to further improve the shelf stability of image, another cationic compound than the above-described cationic compound may be contained within limits not impeding the achievement of the object of the present invention.

No particular limitation is imposed on such a cationic compound so far as it contains a cationic moiety in its molecule.

According to the constitution of the present invention, another cationic compound than the cationic compound by which the present invention is characterized is not an essential component and plays an auxiliary part persistently.

As a means for adjusting the hydrophilicity of the resulting ink-receiving layer, a crosslinking agent such as methylol melamine, methylol urea or methylol hydroxypropyleneurea may be further contained.

Various additives may be used in combination in the composition for the ink-receiving layer within limits not impeding the achievement of the objects of the present invention. Specific examples of the additives include various kinds of surfactants, various kinds of fillers, dye-fixing agents (water-proofing agents), antifoaming agents, antioxidants, optical whitening agents, ultraviolet absorbents, dispersing agents, viscosity modifiers, pH adjusters, mildew-proofing agents and plasticizers. These additives may be optionally selected from the conventionally-known compounds as necessary for the end application intended. A plurality of these additives may be used at the same time.

As the base material for the printing medium used in the present invention, there may be used a paper web such as wood-free paper, medium-quality paper, art paper, bond paper, recycled paper, baryta paper, cast-coated paper, corrugated fiberboard or resin-coated paper, a film formed of a plastic such as polyethylene terephthalate, diacetate, triacetate, cellophane, celluloid, polycarbonate, polyimide, polyvinyl chloride, polyvinylidene chloride, polyacrylate, polyethylene or polypropylene, a board of wood, a glass plate or sheet, or a fabric of cotton, rayon, acrylic, silk, polyester or the like. It goes without saying that the present invention is not limited to these base materials.

The base material may have either a smooth surface or an irregular surface, or be either transparent, translucent or opaque. Two or more of these base materials may be laminated on each other to be used as the base material. A mat layer, pressure sensitive adhesive release layer or the like may be provided on the opposite side of a printing surface, or a pressure sensitive adhesive layer may be provided on a printing surface after printing. The base material is suitably selected from the above-mentioned materials according to various conditions such as the intended printing application of the resulting printing medium, the use of printed images and the adhesiveness to a composition to be coated thereon. In order to obtain a light-transmitting printing medium, a transparent plastic film or glass sheet is used as the base material, while an opaque plastic film or paper is used as the base material for providing a glossy printing medium.

Upon the preparation of the printing medium according to the present invention, the above-described composition is first of all dissolved or dispersed, together with other additives if necessary, in water, or an alcohol, polyhydric alcohol or another suitable organic solvent to prepare a coating formulation.

The coating formulation thus obtained is applied to the surface of the base material by, for example, a roll coater, blade coater, air knife coater, gate roll coater, bar coater, size pressing, spray coating, gravure coater or curtain coater process. Thereafter, the thus-coated base material is dried using, for example, a hot-air drying oven or heating drum, thereby obtaining a printing medium according to the present invention. As needed, the resulting printing medium may be further subjected to supercalendering or the like so as to enhance the smoothness or surface strength of the ink-receiving layer.

The coating weight of the ink-receiving layer is within a range of from 0.2 to 50 g/m$^2$, preferably from 1 to 30 g/m$^2$ in total. If the coating weight is less than 0.2 g/m$^2$, no improving effect is brought about for coloring ability of the coating formulation, ink-absorbing capacity and ink-fixing ability compared with the case where no ink-receiving layer is provided. If the coating weight of the ink-receiving layer provided exceeds 50 g/m$^2$ on the other hand, curling occurs to a marked extent, particularly, in environmental conditions of low temperature and low humidity. The coating weight may preferably be within a range of from 0.5 to 50 $\mu$m in terms of thickness.

When ink-jet printing is conducted on the printing medium described above to form an image, any known inks may be used without problem.

As recording agents, there may be used water-soluble dyes represented by direct dyes, acid dyes, basic dyes, reactive dyes and food colors, and besides disperse dyes and pigments.

These water-soluble dyes, or disperse dyes or pigments are generally used in a proportion of 0.1 to 20% by weight in the conventional inks. In the present invention, they may also be used in such a proportion.

A solvent suitable for use in water-based inks used in the present invention is water or a mixed solvent of water and a water-soluble organic solvent. A mixed solvent composed of water and a water-soluble organic solvent and containing, as the water-soluble organic solvent, a polyhydric alcohol having an effect of inhibiting the drying of the ink is particularly preferred.

A preferred method for conducting printing by applying the above-described ink to the printing medium described above is an ink-jet printing method. As such a method, any system may be used so far as it can effectively eject an ink out of an orifice to apply the ink to the printing medium. In particular, an ink-jet printing system described in Japanese Patent Application Laid-Open No. 54-59936, in which an ink undergoes a rapid volumetric change by an action of thermal energy applied to the ink, so that the ink is ejected out of an orifice by the working force generated by this change of state, may be used effectively.

The present invention will hereinafter be described in more detail by the following examples. Incidentally, all designations of "part" or "parts" and "%" as will be used in the following examples mean part or parts by weight and % by weight unless expressly noted.

Cationic compounds (a) to (e) used in the Examples and Comparative Examples were synthesized in accordance with conventionally-known processes.

Cationic compound (a):

A compound which is composed of 90% of the structural unit of the formula (I-1) and 10% of the structural unit of the formula (II-1) and has a weight average molecular weight of 40,000.

Cationic compound (b):

A compound which is composed of 80% of the structural unit of the formula (I-1) and 20% of the structural unit of the formula (II-1) and has a weight average molecular weight of 40,000.

Cationic compound (c):

A compound which is composed of 90% of the structural unit of the formula (I-1) and 10% of the structural unit of the formula (II-2) and has a weight average molecular weight of 40,000.

Cationic compound (d):

A compound which is composed of 50% of the structural unit of the formula (I-1) and 50% of the structural unit of the formula (III) and has a weight average molecular weight of 200,000.

Cationic compound (e):

A cationic resin which is synthesized in accordance with the process disclosed in Example 1 of Japanese Patent Application Laid-Open No. 8-108618 and has the structural unit of the formula (IV) (weight 10 average molecular weight: 150,000).

(I-1)

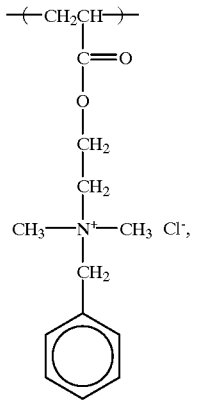

(II-1)

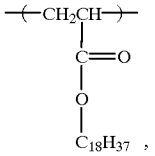

(II-2)

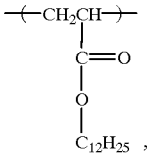

(III)

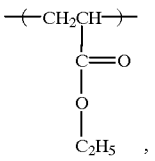

and (IV)

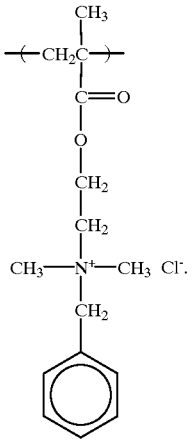

EXAMPLE 1

A coating formulation prepared by mixing a composition composed of 100 parts of polyvinyl alcohol (PVA 217, trade name, product of Kuraray Co., Ltd.; polymerization degree: 1,700; saponification degree: about 88 mol %) and 10 parts of the cationic compound (a) was applied to resin-coated paper (RC Gloria Manila, trade name, product of Gojo Seishi K.K.) using a wire bar so as to give a dry coating thickness of 10 $\mu$m. The paper thus coated was then dried at 120° C. for 3 minutes to prepare a printing medium.

EXAMPLE 2

A printing medium was prepared in the same manner as in Example 1 except that the polyvinyl alcohol used in Example 1 was changed to cationically modified polyvinyl alcohol (CM-318, trade name, product of Kuraray Co., Ltd.; polymerization degree: 1,700; saponification degree: about 88 mol %).

EXAMPLE 3

A printing medium was prepared in the same manner as in Example 1 except that the polyvinyl alcohol used in Example 1 was changed to acetal-modified polyvinyl alcohol (KW-1, trade name, product of Sekisui Chemical Co., Ltd.).

EXAMPLE 4

A printing medium was prepared in the same manner as in Example 1 except that the polyvinyl alcohol used in Example 1 was changed to 50 parts of a urethane resin (Hydrane HM-940, trade name, product of Dainippon Ink & Chemicals Incorporated) and 50 parts of polyvinyl alcohol (PVA 217, trade name, product of Kuraray Co., Ltd.; polymerization degree: 1,700; saponification degree: about 88 mol %).

EXAMPLE 5

A printing medium was prepared in the same manner as in Example 1 except that 20 parts of the cationic compound (a) is used to 100 parts of the polyvinyl alcohol.

EXAMPLE 6

A printing medium was prepared in the same manner as in Example 1 except that 30 parts of the cationic compound (a) is used to 100 parts of the polyvinyl alcohol.

EXAMPLE 7

A printing medium was prepared in the same manner as in Example 1 except that 5 parts of the cationic compound (a) is used to 100 parts of the polyvinyl alcohol.

EXAMPLE 8

A printing medium was prepared in the same manner as in Example 1 except that the base material used in Example 1 was changed to a transparent PET film (Mellinex 535, trade name, product of ICI, Ltd.;

thickness: 100 $\mu$m).

EXAMPLE 9

A printing medium was prepared in the same manner as in Example 1 except that the cationic compound (a) used in Example 1 was changed to the cationic compound (b).

EXAMPLE 10

A printing medium was prepared in the same manner as in Example 1 except that the cationic compound (a) used in Example 1 was changed to the cationic compound (c).

COMPARATIVE EXAMPLE 1

A printing medium was prepared in the same manner as in Example 1 except that the cationic compound (a) used in Example 1 was not used, and only the polyvinyl alcohol (PVA 217, trade name, product of Kuraray Co., Ltd.; polymerization degree: 1,700; saponification degree: about 88 mol %) was used.

COMPARATIVE EXAMPLE 2

A printing medium was prepared in the same manner as in Example 1 except that 0.5 parts of the cationic compound (a) is used to 100 parts of the polyvinyl alcohol.

COMPARATIVE EXAMPLE 3

A printing medium was prepared in the same manner as in Example 1 except that 50 parts of the cationic compound (a) is used to 100 parts of the polyvinyl alcohol.

COMPARATIVE EXAMPLE 4

A printing medium was prepared in the same manner as in Example 1 except that the cationic compound (a) used in Example 1 was changed to the cationic compound (d).

COMPARATIVE EXAMPLE 5

A printing medium was prepared in the same manner as in Example 1 except that the cationic compound (a) used in Example 1 was changed to the cationic compound (e).

COMPARATIVE EXAMPLE 6

A printing medium was prepared in the same manner as in Example 1 except that the cationic compound (a) used in Example 1 was changed to polyallylamine hydrochloride (PAA-HCl-10L, trade name, product of Nitto Boseki Co., Ltd.).

Using inks each having the following compositions, color printing was conducted on the printing media thus obtained under the following conditions by means of an ink-jet printing apparatus of a bubble jet system that an ink is ejected by bubbling of the ink by thermal energy.

Composition of ink (black):

C.I. Direct Black 19 3 parts

Glycerol 6 parts

Ethylene glycol 5 parts

Isopropyl alcohol 3 parts

Urea 5 parts

Water 78 parts.

The surface tension of this ink was about 45 dyn/cm.

Composition of inks (yellow, magenta, cyan):

Dye 4 parts

Glycerol 7 parts

Thiodiglycol 7 parts

Urea 7 parts

Acetylene glycol 1.5 part

Water 73.5 parts.

The surface tension of each ink was about 35 dyn/cm.

Dye:

Yellow: C.I. Direct Yellow 86

Cyan: C.I. Direct Blue 199

Magenta: C.I. Acid Red 23.

Printing conditions:

Ejection frequency: 6.25 kHz

Volume of ejection droplet: 40 pl

Printing density:

720 dpi (main scanning direction)

360 dpi (secondary scanning direction)

Maximum application volume of a single color ink: 14 nl/mm$^2$

Feeding system: ASF (auto sheet feeder).

The resulting color print samples were evaluated as to the following items. The results are shown in Table 2.

The evaluation of the printing media using a transparent base material was conducted by projecting an image formed on each printing medium sample by a transmission type projector M4000 (trade name, manufactured by Sumitomo 3M Limited) and evaluating the projected image.

Evaluated items:

(1) Image quality:

Each of the print samples obtained was visually evaluated as to both evenness of a solid printed portion and bleeding at boundaries between different colors.

A lateral-striped pattern (2 cm×15 cm/stripe) of black, cyan, magenta, yellow, red, green and blue colors was formed as an image for evaluation and used in the evaluation. The image quality was ranked as A where no color irregularity such as beading occurred, evenness of the solid printed portions was excellent, and no bleeding occurred at boundaries between different colors, C where color irregularity such as beading occurred, evenness of the solid printed portions was poor, and bleeding occurred at boundaries between different colors, so that image quality was remarkably poor, or B where it was intermediate thereto.

(2) Coloring ability:

Evaluation was visually conducted. Square solid prints (each 3 cm×3 cm) of black, cyan, magenta, yellow, red, green and blue colors were formed as an image for evaluation and used in the evaluation.

The coloring ability was ranked as A where coloring was not different from that of an image formed on an ink-receiving layer without addition of a cationic compound, C where coloring was remarkably different, or B where it was intermediate thereto.

(3) Shelf stability of image:

After printing was conducted on each printing medium by means of the above-described printer, and the printed image thus obtained was stored for 7 days in an environment of 30° C./80% RH, the shelf stability of image was evaluated in comparison with the image before the storage.

Square solid prints (each 3 cm×3 cm) of black, cyan, magenta, yellow, red, green and blue colors, on which a white offprint-line of 0.3 mm width was printed, were formed as an image for evaluation and used in the evaluation.

The shelf stability of image was ranked as C where ink running and exudation occurred, so that image quality was remarkably poor compared with the image before the storage, AA where no change was recognized compared with the image before the storage, A where ink exudation somewhat occurred, or B where it was intermediate to A and C.

(4) Light fastness:

Each print sample was exposed for 30 hours to light from a xenon lamp in an Atlas fade-o-meter (trade name; manufactured by Toyo Seiki Seisakusho, Ltd.) to compare the exposed sample with the sample before the exposure. The image densities of black, cyan, magenta and yellow colors were measured before and after the test to determine percent retention of each image density after the test. Square solid prints (each 3 cm ×3 cm) of black, cyan, magenta and yellow colors were formed as an image for evaluation and used in the evaluation.

The light fastness was ranked as C where the percent retention was lower than 50% even on one color, A where the percent retention of each color was not lower than 80%, or B where it was intermediate thereto.

TABLE 2

| | Image quality | | | | |
|---|---|---|---|---|---|
| | Evenness of solid print | Bleeding between different colors | Coloring ability | Shelf stability of image | Light fastness |
| Ex. 1 | A | A | A | AA | A |
| Ex. 2 | A | A | A | A | A |
| Ex. 3 | A | A | A | AA | A |
| Ex. 4 | A | A | A | A | A |
| Ex. 5 | A | A | A | AA | A |
| Ex. 6 | A | A | A | AA | A |
| Ex. 7 | A | A | A | A | A |
| Ex. 8 | A | A | A | AA | A |
| Ex. 9 | A | A | A | AA | A |
| Ex. 10 | A | A | A | AA | A |
| Comp. Ex. 1 | A | A | A | C | A |
| Comp. Ex. 2 | A | A | A | C | A |
| Comp. Ex. 3 | C | C | C | A | C |
| Comp. Ex. 4 | A | A | A | C | B |
| Comp. Ex. 5 | A | A | B | C–B | A |
| Comp. Ex. 6 | A | A | C–B | C | B |

According to the present invention, as described above, there can be provided printing media having ideal performance requirements, namely, that ink absorbency is excellent, a high-definition image high in optical density can be formed, and the printed image thus obtained has excellent shelf stability without deterioration even when left to stand for a long period of time, particularly, in a high-temperature and high-humidity environment, and moreover excellent light fastness.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A printing medium, comprising a base material and an ink-receiving layer provided on at least one side of the base material, wherein the ink-receiving layer comprises a hydrophilic resin and a cationic compound comprising both structural units of the formulae (I) and (II)

(I)

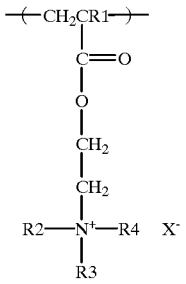

and (II)

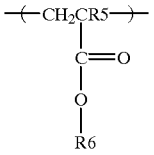

wherein R1, R2, R4 and R5 are independently hydrogen or an alkyl group having 1 to 3 carbon atoms, R3 is a phenyl, naphthyl, benzyl or phenethyl group, R6 is an alkyl group the main chain of which has 10 to 30 carbon atoms, and $X^-$ is a halide ion selected from the group consisting of chloride, bromide and iodide ions, a sulfate ion, an alkylsulfate ion selected from the group consisting of methylsulfate and ethysulfate ions, an alkyl- or arylsulfonate ion, or an acetate ion, and the cationic compound is used in combination in a proportion of from 1 to 40 parts by weight per 100 parts by weight of the hydrophilic resin.

2. The printing medium according to claim 1, wherein the proportions of the structural units of the formulae (I) and (II) in the cationic compound are within ranges of from 60% by weight to 95% by weight and from 5% by weight to 40% by weight, respectively.

3. The printing medium according to claim 2, wherein the proportions of the structural units of the formulae (I) and (II) in the cationic compound are within ranges of from 70% by weight to 95% by weight and from 5% by weight to 30% by weight, respectively.

4. The printing medium according to claim 3, wherein the proportions of the structural units of the formulae (I) and (II) in the cationic compound are within ranges of from 75% by weight to 95% by weight and from 5% by weight to 25% by weight, respectively.

5. The printing medium according to claim 1, wherein in the cationic compound, R3 is a benzyl group, and R6 is a long-chain alkyl group the main chain of which has 12 to 18 carbon atoms.

6. The printing medium according to claim 1, wherein the cationic compound has a weight average molecular weight of from 10,000 to 500,000.

7. The printing medium according to claim 6, wherein the cationic compound has a weight average molecular weight of from 10,000 to 200,000.

8. The printing medium according to claim 7, wherein the cationic compound has a weight average molecular weight of from 10,000 to 100,000.

9. The printing medium according to claim 1, wherein the hydrophilic resin comprises at least one of polyvinyl alcohol and modified products thereof, polyurethane, polyvinyl pyrrolidone and modified products thereof, cellulosics and modified products thereof, polyester, and copolymers of polyurethane and polyester.

10. The printing medium according to claim 9, wherein the hydrophilic resin is selected from the group consisting of polyvinyl alcohol, cationically modified polyvinyl alcohol, acetal-modified polyvinyl alcohol, polyurethane, polyester, and copolymers of polyurethane and polyester.

11. The printing medium according to claim 1, wherein the proportion of the cationic compound is from 5 to 30 parts by weight per 100 parts by weight of the hydrophilic resin.

12. The printing medium according to claim 11, wherein the proportion of the cationic compound is from 5 to 25 parts by weight per 100 parts by weight of the hydrophilic resin.

13. The printing medium according to claim 1, wherein the base material is a plastic film or resin-coated paper.

14. An ink-jet printing process comprising the steps of providing inks, and ejecting the inks from orifices of a printing head in response to printing signals to apply the inks to the printing medium according to any one of claims 1 to 10 or 11 to 13, thereby conducting printing.

15. The ink-jet printing process according to claim 14, wherein the liquid medium component in the inks comprises water and a water-soluble organic solvent.

16. The ink-jet printing process according to claim 14, wherein the inks are cyan, magenta, yellow and black inks.

17. The ink-jet printing process according to claim 14, wherein the inks are ejected by thermal energy.

18. An image forming process comprising the steps of providing water-based inks, and applying the water-based inks to the printing medium according to any one of claims 1 to 10 or 11 to 13, thereby forming an image.

19. The image forming process according to claim 18, wherein the liquid medium component in the inks comprises of water and a water-soluble organic solvent.

20. The image forming process according to claim 18, wherein the inks are cyan, magenta, yellow and black inks.

21. The image forming process according to claim 18, wherein the inks are ejected by thermal energy.

* * * * *

UNITED STATES PATENT AND TRADEMARK OFFICE

CERTIFICATE OF CORRECTION

PATENT NO. : 5,985,453

DATED : November 16, 1999

INVENTOR(S) : KENICHI MORIYA, ET AL.

It is certified that error appears in the above-identified patent and that said Letters Patent is hereby corrected as shown below:

COLUMN 16:

Line 30, "ethysulfate" should read --ethylsulfate--.

COLUMN 17:

Line 18, "10 or 11 to 13," should read --13,--.

UNITED STATES PATENT AND TRADEMARK OFFICE

CERTIFICATE OF CORRECTION

PATENT NO. :5,985,453

DATED :November 16, 1999

INVENTOR(S) :KENICHI MORIYA, ET AL.

It is certified that error appears in the above-identified patent and that said Letters Patent is hereby corrected as shown below:

Column 18 :

Line 11, "1 to 10 or 11 to 13, " should read -- 1 to 13, --.

Line 14, "of" should be deleted.

Signed and Sealed this

Twenty-sixth Day of December, 2000

*Attest:*

Q. TODD DICKINSON

*Attesting Officer*

*Director of Patents and Trademarks*